US006042263A

United States Patent [19]

Mentzer et al.

[11] Patent Number: 6,042,263

[45] Date of Patent: Mar. 28, 2000

[54] MIXED PHASE RUFF BODY FLOW DIFFUSER

[76] Inventors: Marvin R. Mentzer, Omaha, Nebr.; Diane Mentzer, legal representative, 3617 County Rd. P38, Omaha, Nebr. 68152

[21] Appl. No.: 09/069,254

[22] Filed: Apr. 29, 1998

[51] Int. Cl.[7] ..... B01F 5/06

[52] U.S. Cl. ..... 366/340; 366/336; 138/44

[58] Field of Search ..... 366/336, 337, 366/338, 339, 340; 138/37, 40, 44, 42

[56] References Cited

U.S. PATENT DOCUMENTS

| | | | |
|---|---|---|---|
| 1,689,446 | 10/1928 | Miller et al. | 366/338 |
| 2,618,143 | 11/1952 | McConaugy | 366/340 |
| 3,153,378 | 10/1964 | Taylor | 366/336 |
| 4,392,438 | 7/1983 | Dooley . | |
| 4,573,801 | 3/1986 | Leschonski et al. . | |
| 4,832,500 | 5/1989 | Brunold et al. | 366/340 |
| 5,048,761 | 9/1991 | Kim . | |
| 5,285,735 | 2/1994 | Motoi et al. . | |
| 5,309,946 | 5/1994 | Ligneul | 366/337 |
| 5,427,181 | 6/1995 | Laskaris et al. | 366/336 |
| 5,560,550 | 10/1996 | Krawczyk . | |
| 5,685,240 | 11/1997 | Briggs, Jr. et al. . | |

FOREIGN PATENT DOCUMENTS

| | | | |
|---|---|---|---|
| 2430487 | 8/1975 | Germany | 366/340 |
| 29573 | 12/1970 | U.S.S.R. | 366/337 |
| WO 82/02004 | 6/1982 | WIPO | 366/337 |
| WO 92/11928 | 7/1992 | WIPO | 366/336 |

*Primary Examiner*—Tony G. Soohoo
*Attorney, Agent, or Firm*—Henderson & Sturm

[57] ABSTRACT

A mechanical device that dynamically, through the change in velocity-caused sheer planes, effectively produces a more homogenized mixed phase flow stream downstream from a non-homogenized phase concentrated stream. The device is unique in that it does not rely on physical contact with mechanical surfaces of each phase in the stream to re-direct the phases into a re-distributed mixture. This effect is generated dynamically with the pressure differentials caused by sheer planes and dynamic recirculation zones at different velocities. This differential pressure gradient is developed by inserting a pre-designed non-aerodynamic symmetrical device in a mixed phase flow path to produce a re-circulating flow disrupting the laminar flow characteristics. The diffuser design is based on a proprietary calculation methodology based on the physical arrangement of the stream containment. This arrangement may be rectangular, conical, round, oval, multi-sided or annular in configuration. The invention may be in a fixed position or made to travel in a determined path depending on the process requirements. Consecutive unique units may be used in series for some processes.

6 Claims, 2 Drawing Sheets

MIXED PHASE RUFF BODY FLOW DIFFUSER

CROSS-REFERENCE TO RELATED APPLICATIONS

Not Applicable.

STATEMENT REGARDING FEDERALLY SPONSORED RESEARCH OR DEVELOPMENT

Not Applicable.

AUTHORIZATION PURSUANT TO 37 C.F.R. § 1.71 (d) (e)

A portion of the disclosure of this patent document, including appendices, may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to process stream flow diffusers, and more particularly to a mixed phase flow diffuser.

2. Description of the Related Art

Mixed phase steams include pneumatic-conveyed solids and liquids fed into a reactor, burner, boiler or other coating or abrasive blasting process. Such multi-phase conveying processes are commonly non-homogeneous due to stream conduits that change direction through elbows, scrolls, pipe reducers, valves, etc. that cause centrifugal separation or impact separation of the respective phases of material in the stream. Roping and gravitational spinning can also occur. To achieve re-homogenization of the stream, devices such as anti-roping bars, riffle stream separation and re-entrainment, volutes, agitators, etc. are used that require energy inputs that are unrecoverable.

Those concerned with these and other problems recognize the need for an improved mixed phase buff body flow diffuser.

BRIEF SUMMARY OF THE INVENTION

This present invention provides a mechanical device that dynamically, through the change in velocity-caused sheer planes, effectively produces a more homogenized mixed phase flow stream downstream from a non-homogenized phase concentrated stream. The device is unique in that it does not rely on physical contact with mechanical surfaces of each phase in the stream to re-direct the phases into a re-distributed mixture. This effect is generated dynamically with the pressure differentials caused by sheer planes and dynamic recirculation zones at different velocities. This differential pressure gradient is developed by inserting a pre-designed non-aerodynamic symmetrical device in a mixed phase flow path to produce a re-circulating flow disrupting the laminar flow characteristics. The diffuser design is based on a proprietary calculation methodology based on the physical arrangement of the stream containment. This arrangement may be rectangular, conical, round, oval, multi-sided or annular in configuration. The invention may be in a fixed position or made to travel in a determined path depending on the process requirements. Consecutive unique units may be used in series for some processes.

The invention may be molded, cast, spun or fabricated from any rigid or semi-rigid material suitable for the process environment. It may be added to or an integrally formed part of the process stream conduit in the shape necessary to generate the required velocity gradients.

The primary objective of the invention is to provide a downstream well-homogenized process flow steam.

An additional objective is to provide a mixed phase flow diffuser where the pressure recovery rate achieved by the conversion of velocity head back to pressure head after the re-entrainment diffusing process is completed downstream of the diffuser, wherein the net energy consumption of the process flow stream alteration is greatly reduced compared to other commonly known and used devices.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
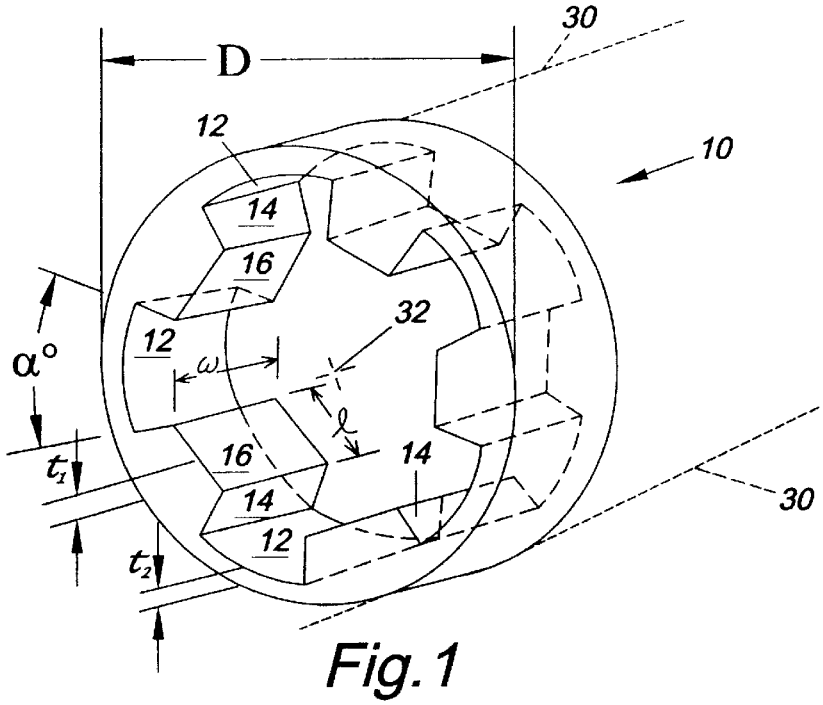
FIG. 1 is a perspective view of one embodiment of the mixed phase buff body flow diffuser of the present invention.
Figure 2:
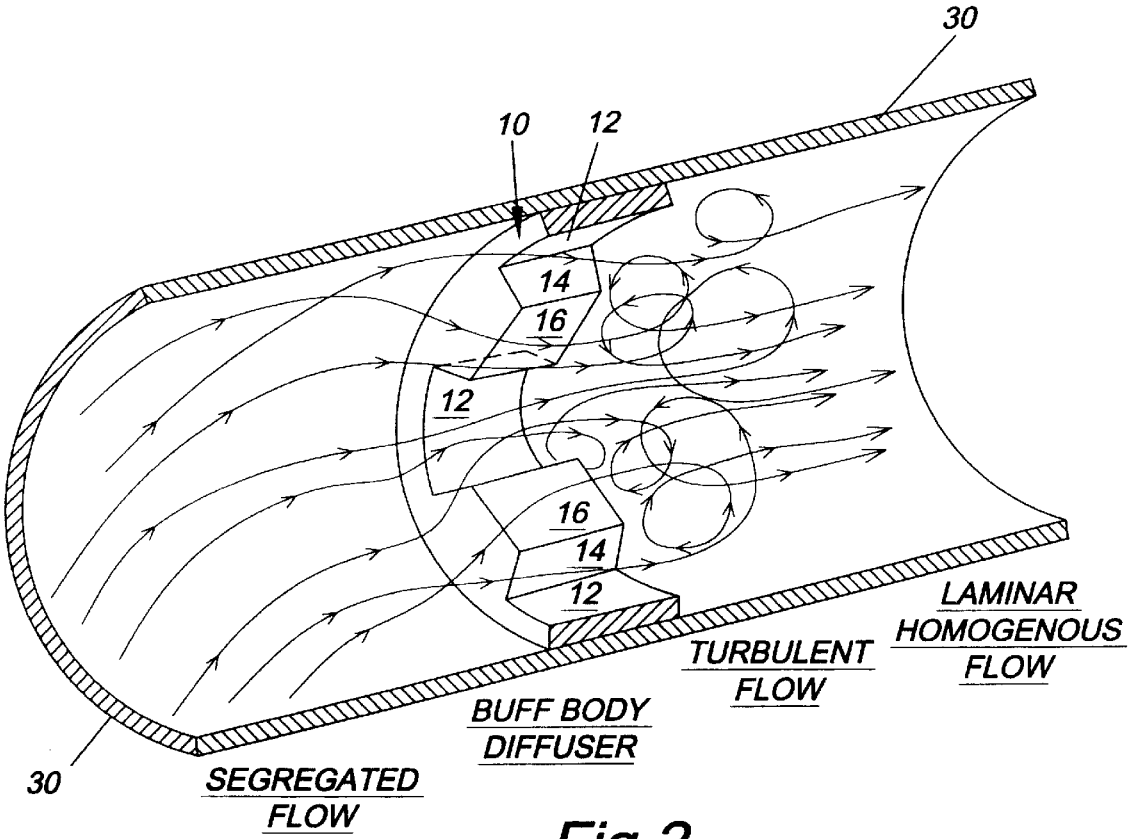
FIG. 2 is a sectional perspective view illustrating the diffuser of FIG. 1 installed in a flow stream conduit.

Referring now to the drawings, wherein like reference numerals designate identical or corresponding parts throughout the several views, FIGS. 1 and 2 show a mixed phase buff body flow diffuser 10 suitable for use in a flow stream conduit 30 having a circular cross-section. The dimensions D, 1, $t_1$, $t_2$, and w, and the angle $\alpha$ are a function of the application velocities, specific gravities of the mixed phase materials, velocity direction vectors, and cross-sectional shape of the flow stream conduit.

The diffuser 10 includes three restricted surfaces 12, 14, and 16 which are positioned at different distances from the geometric center 32 of the conduit 30. The diffuser 10 is positioned within the conduit 30 downstream of the last impact separation point, such as an elbow, so that a homogenous stream is discharged, for example, into a burner. The composition of the mixed phase stream will include a gaseous carrier in combination with a liquid and/or solid.

FIG. 2 illustrates segregated flow upstream of the diffuser 10, turbulent flow immediately downstream of the diffuser 10, and laminar homogenous flow further downstream. Materials of different phases that have separated in the conduit are thus mixed or homogenized by flowing through the diffuser 10.

Figure 3:
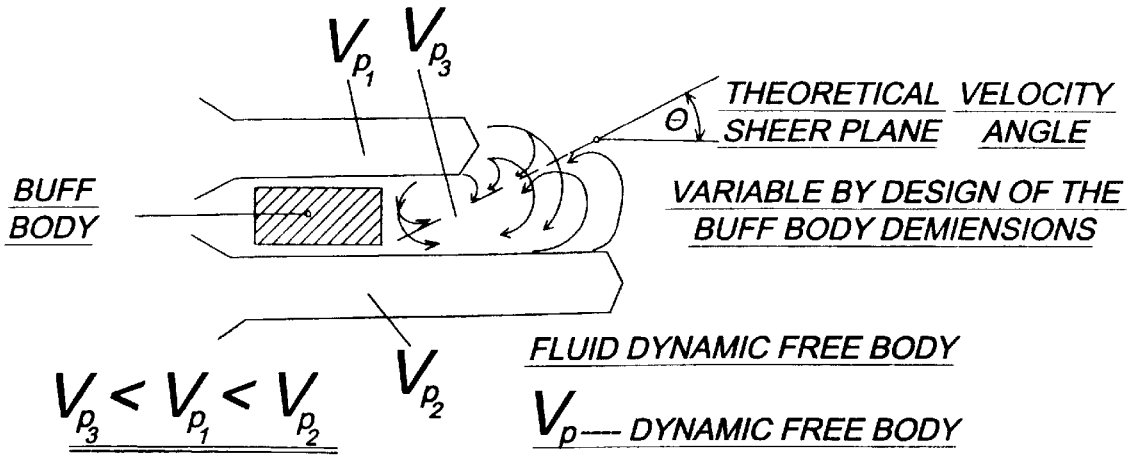
FIG. 3 is a schematic view illustrating the fluid dynamics of a buff body in a flow stream.

FIG. 3 illustrates that the three restricted surfaces 12, 14 and 16 of the diffuser 10 causes the mixed phase stream to flow through the diffuser 10 at three distinct velocities thus creating three distinct pressures. This illustrated model generates circumferential and radial internal dynamic recirculation zones. Sheer planes are developed between the velocity over surface 14 and surface 16 to produce a circumferential recirculation and between the velocities over surface 12 and 16 to produce radial recirculation. Material passing proximate the surface 16 closest to the geometric center 32 travels at the highest velocity and results in the lowest pressure since it is the most restricted. Material passing proximate the surface 14 travels at a lesser velocity, and material passing over surface 12 travels at the lowest velocity. The lowest pressure zone created at the center of the conduit 30 causes the materials in the stream to flow to the lowest pressure zone from the zones of higher pressure and effectively mix the materials into a laminar homogenous flow.

Figure 4:
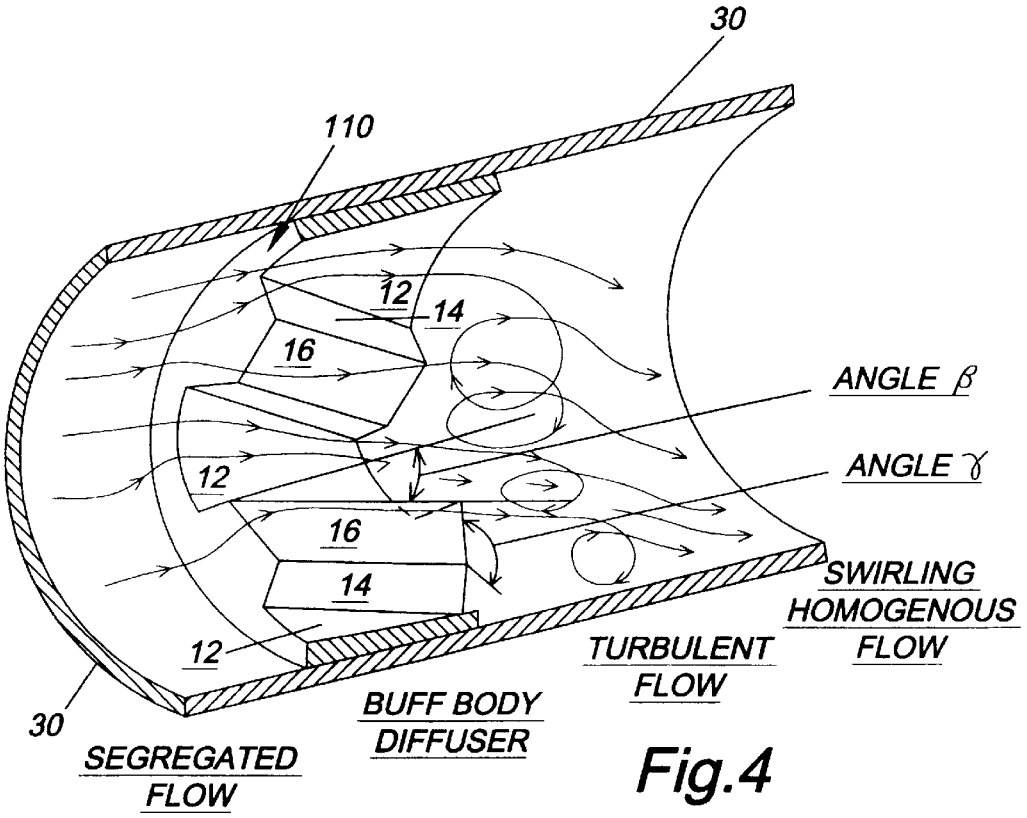
FIG. 4 is a sectional perspective view similar to FIG. 2, but illustrating an alternative embodiment of a diffuser not having co-axial symmetry.

FIG. 4 illustrates a diffuser 110 having a departure from co-axial symmetry resulting in the generation of circumferential recirculation that will impart a net swirl to the mixed stream to suit downstream process requirements. Angles β and γ produce net swirling recirculation.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A mixed phase flow diffuser for a flow stream conduit having an interior wall, and an axis disposed at the cross-sectional geometric center of the conduit, the diffuser comprising:

a body having a central open area and including:

a peripheral edge disposed coincident with the interior wall;

a leading edge extending inwardly from the interior wall, the leading edge defining a first impact surface and a second impact surface, the first impact surface being a ring disposed perpendicular to a direction of flow and having a first radial thickness, wherein entrained solids flowing near the interior wall and impacting the first impact surface are forced radially away from the interior wall where the solids are entrained in a bulk carrier, the second impact surface being a plurality of circumferentially spaced blocks disposed perpendicular to the direction of flow and having a second radial thickness extending radially inward from the ring, wherein entrained solids impacting the second impact surface are deflected between adjacent blocks in a circumferential direction and are deflected over the blocks in a radially inward direction where the solids are entrained in the bulk carrier;

a following edge extending inwardly from the interior wall and being spaced from the leading edge to define a body width, the following edge being substantially identical in shape and size to the leading edge, wherein secondary turbulent eddies are formed around the following edge when a flow stream of the solids entrained in the bulk carrier flows past the following edge;

a first restricted surface disposed inward from the interior wall and parallel to the axis at the first radial thickness, the first restricted surface extending across the width of the body and interconnecting the leading and following edges;

a second restricted surface disposed inward from the first restricted surface and parallel to the axis at the second radial thickness, the second restricted surface extending across the width of the body and interconnecting the leading and following edges; and a third restricted surface extending radially inward between the first and second restricted surfaces and across the width of the body and interconnecting the leading and following edges.

2. The diffuser of claim 1, wherein the third restricted surface is disposed co-axially with the axis of the conduit.

3. The diffuser of claim 2, wherein a plurality of first, second and third restricted surfaces are symmetrically disposed around the interior wall of the conduit.

4. The diffuser of claim 1, wherein the third restricted surface is angularly disposed with respect to the axis of the conduit.

5. The diffuser of claim 4, a plurality of first, second and third restricted surfaces are symmetrically disposed around the interior wall of the conduit.

6. The diffuser of claim 1, wherein a plurality of first, second and third restricted surfaces are symmetrically disposed around the interior wall of the conduit.

* * * * *

UNITED STATES PATENT AND TRADEMARK OFFICE

CERTIFICATE OF CORRECTION

PATENT NO. : 6,042,263
DATED : March 28, 2000
INVENTOR(S) : Marvin R. Mentzer, Diane Mentzer, legal representative It is certified that error appears in the above-identified patent and that said Letters Patent is hereby corrected as shown below:

Item [54] and Column 1, lines 1-2, the title should read:

MIXED PHASE BUFF BODY FLOW DIFFUSER.

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*